United States Patent [19]

Barannik et al.

[11] 3,969,104

[45] July 13, 1976

[54] GRANULES OF MAGNESIUM AND ITS ALLOYS

[76] Inventors: Ivan Andreevich Barannik, ulitsa Lenina, 182a, kv. 22, Zaporozhie; Gennady Ivanovich Belkin, ulitsa Kaliinaya, 7, kv. 13, Solikamsk; Viktor Ivanovich Borodin, ulitsa Fersmana, 18, kv. 13, Apatity Murmanskoi oblasti; Natalya Alexandrovna Voronova, pereulok Uritskogo, 11, kv. 4, Dnepropetrovsk; Oleg Nikolaevich Romanenko, ulitsa Sevastopolskaya, 6, kv. 46, Kalush Ivano-Frankovskoi oblasti; Alexandr Petrovich Bogdanov, bulvar Tsentralny, 3, kv. 44, Zaporozhie; Valery Sergeevich Belosludtsev, ulitsa Kaliinaya, 144, kv. 13; Vladimir Dmitrievich Marfin, ulitsa Kaliinaya, 153, kv. 33, both of Solikamsk; Nikolai Yakovlevich Shish, ulitsa Gryaznova, 88, kv. 3, Zaporozhie; Anatoly Filippovich Shevchenko, ulitsa G. Pushkina, 1b, kv. 52; Ivan Yakovlevich Emelyanov, ulitsa G. Pushkina, 1b, kv. 58, both of Dnepropetrovsk; Jury Nikolaevich Boiko, prospekt Lenina, 155, kv. 10, Zaporozhie; Mikhail Nikolaevich Kljuchnik, ulitsa Kalinovaya, 94, kv. 46, Dnepropetrovsk; Nikolai Vasilievich Khaber, ulitsa Sevastopolskaya, 4, kv. 6, Kalush Ivano-Frankovskoi olbasti; Viktor Georgievich Raskatov, ulitsa Khimikov, 14, kv. 18, Kalush Ivano-Frankovskoi oblasti; Alexandr Fedorovich Trukhin, ulitsa Zhdanova, 11, kv. 32, Kalush Ivano-Frankovskoi oblasti; Anatoly Borisovich Kondratenko, ulitsa Sevastopolskaya, 4, kv. 6, Kalush Ivano-Frankovskoi oblasti; Vladimir Dmitrievich Yazev, ulitsa Bogdana Khmelnitskogo, 66, kv. 59, Kalush Ivano-Frankovskoi oblasti; Viktor Stepanovich Alontsev, ulitsa Kaliinaya, 124, kv. 15; Valery Alexeevich Startsev, ulitsa Kaliinaya 124, kv. 4, both of Solikamsk; Jury Alexandrovich Sergeev, prospekt Lenina, 182a, kv. 23, Zaporozhie, all of U.S.S.R.

[22] Filed: Feb. 18, 1975

[21] Appl. No.: 550,767

Related U.S. Application Data

[62] Division of Ser. No. 443,845, Feb. 19, 1974, Pat. No. 3,881,913.

[52] U.S. Cl. ..... 75/.5 B; 75/.5 R

[51] Int. Cl.[2] ..... B22D 23/08

[58] Field of Search ..... 264/8; 75/.5 B, .5 C, 75/.5 R

[56] References Cited

UNITED STATES PATENTS

| | | | |
|---|---|---|---|
| 2,304,130 | 12/1942 | Truthe | 264/8 |
| 2,699,576 | 1/1955 | Colbry et al. | 264/8 |
| 3,520,718 | 7/1970 | Reding | 264/8 X |

*Primary Examiner*—Arthur J. Steiner
*Attorney, Agent, or Firm*—Haseltine, Lake & Waters

[57] ABSTRACT

The invention relates to magnesium-containing mixtures, in the form of granules of a particular shape, made by the introduction of a salt to liquid metal at a temperature of 670°–720°C, heated to a temperature of 670°–730°C, composed of metal chlorides and fluorides not reducible by magnesium, taken separately or in combination, and having an initial crystallization temperature below that of the granulated metal, and a density at the temperature of 670°–730°C equal to 0.95–1.2 of the density of the metal. The molten mixture is atomized by centrifugal force with subsequent cooling of the thus produced discrete particles by air flow. The mixture obtained in producing granules of magnesium or its alloys comprises in weight per cent: 65–97 of granulated magnesium, 0.3–16 of magnesium and alkali metal chlorides, 0.1–10 of one of the fluorides, up to 3 of alkaline-earth metal chlorides, and up to 6 of magnesium oxide. The above mixture can also comprise in weight per cent: 60–97 of granulated magnesium alloy, 0.3–16 of magnesium and alkali metal chlorides, 0.1–10 of one of the fluorides, 0.3–10 of alkaline-earth metal chlorides, and not over 5.0 of magnesium oxide.

7 Claims, No Drawings

GRANULES OF MAGNESIUM AND ITS ALLOYS

This application is a divisional application of Ser. No. 443,845, filed Feb. 19, 1974, now U.S. Pat. No. 3,881,913 dated May 6, 1975, titled "Method Of Producing Granules Of Magnesium And Its Alloys".

The invention relates to discrete solid metal particles and in particular granules of magnesium and magnesium-base alloys.

A method is known of producing granules of aluminium and magnesium or their alloys by centrifuging liquid metal with the help of a rotating disk, bowl or perforated cup. In this method of producing particles of of magnesium or magnesium-base alloys the centrifuging and subsequent cooling of produced particles are effected in a medium of gases which are inert with respect to magnesium (U.S. Pat. Nos. 2,699,576, 2,676,359, 2,934,789).

Also known is a method of producing granules of magnesium and its alloys by atomizing liquid metal, consisting in that a salt is introduced into the liquid metal prior to atomization having a melting temperature above that of magnesium, for example alkali and alkali-earth metalchlorides in the amount of 2–20 percent by weight. However, the above methods of producing granules of magnesium have the following disadvantages:

the application of the protective atmosphere of inert gases makes the process costly and relatively complicated in terms of equipment needed, while using such gases as hydrogen, methane, propane and the like also adds an explosion hazard to the process; and the introduction into the molten metal of a salt having a melting temperature higher than that of magnesium affords no reliable protection of the dispersed liquid metal against oxidizing by atmospheric oxygen, which makes the process actually uncontrolled because of the periodic ignition of the magnesium in the course of the dispersing. This leads to the production of randomly shaped particles with heavily oxidized surfaces.

The granules according to the present invention are made by centrifuging molten metal with a salt addition which possesses a certain combination of physical and chemical properties permitting the process to be carried out in air to produce granules of given shape and desired quality (in terms of its chemical composition).

The invention selects a salt addition of such chemical composition and amount which besides making possible the normal granulating process in air also makes it possible to produce magnesium-containing mixtures comprising the required amount of metal granules and the added salt in the form of granules and a thin film on the surface of the metal granules, to make the mixture less hygroscopic and less flammable.

The invention produces mixtures which make it possible to increase the rate of utilization of magnesium used in treating cast iron and other metals for desulphurization or inoculation.

The present invention provides granulation with salt additions which besides assuring the normal operation of the granulating process can be easily removed by further hydrochemical treatment to produce granulated magnesium or its alloys, not inferior in terms of activity to magnesium powders produced by milling, or atomization in an inert atmosphere.

The invention produces the granules of magnesium or its alloys by simultaneously delivering into a centrifugal granulator continuous flows of liquid magnesium or its alloys and a salt which is a mixture of magnesium chloride and at least one salt selected from the group of alkaline and alkali-earth metal-chlorides, breaking the mixture of liquid magnesium or its alloy and the added salt by the action of centrifugal force into discrete liquid particles with subsequent cooling of the produced granules in qir. air.

According to the invention the added salt mixture comprises such components and in such quantities that the initial crystallization temperature of the salt addition is below that of magnesium, and its density at 670°–730°C is equal to 0.95–1.2 of the density of liquid magnesium or its alloy in the same temperature range. The delivery into the centrifugal granulator of the magnesium or its alloy is effected at a temperature within the range of 670°–720°C, and the salt addition at a temperature within the range of 670°–730°C.

The salt addition prepared according to the above requirements, when maintaining the above-mentioned temperature range in heating the salt addition and the liquid metal, provides reliable protection for droplets of liquid magnesium or magnesium alloy produced during the centrifugal atomization, against direct contact with atmospheric oxygen before their solidification into granules.

The salt addition having a lower melting temperature than magnesium and a density close to that of magnesium is centrifuged simultaneously with the metal, and spreads in the form of a thin salt film over the surface of each metal droplet, thus, protecting it against contact with atmospheric oxygen. This protective action of the salt film may continue up to the moment of its crystallization which should come after the solidification of the metal particles. If crystallization of the salt addition takes place before the solidification of the metal protected thereby, intensive oxidation of metal granules occurs, often accompanied by ignition.

Instability of the granulating process shown by in the intensive oxidation (burning) of magnesium in the course of its atomization and resulting in granules with heavily oxidized surfaces and random shapes may be caused by overheating the metal in excess of 720°C or, on the other hand, its insufficient heating to less than 670°C.

The temperature of the salt addition at the moment of bringing it to the liquid metal should be approximately equal to the temperature of the metal, however consideration should be taken of its initial crystallization temperature. Substantial heating of the salt addition in excess of its melting temperature leads to the undesirable effect of producing a solid conglomeration consisting of metal granules cemented to each other by the salt addition which because of the high degree of heating thereof has no time to solidify until the moment of striking the wall of the granule-collecting chamber.

Carrying out the granulating process with insufficient heating of the salt addition causes its premature solidification on the surface of the not yet solidified metal particles and consequently the intensive oxidation of these particles by atmospheric oxygen.

To reduce hygroscopicity and increase corrosion resistance of the metal-salt mixture formed after cooling down the granules of magnesium or its alloy and the added salt, the salt addition according to the invention includes 0.5–10 percent by weight of magnesium, sodium and alkaline-earth metal fluorides, taken separately or in combination. It is known that magnesium, sodium and alkaline-earth metalfluorides are less hygroscopic salts than similar chlorides. Besides, fluorides are known to improve corrosion resistance of magnesium and its alloys by forming on the metal surface a thin protective fluoride, film. However, application of a salt addition composed merely of fluorides is difficult because of the high melting temperature of fluorides. Furthermore, it hampers the subsequent hydrochemical treatment of granules because in practice they are not soluble in water.

Therefore, to produce granulated magnesium-containing mixtures it is preferred in practice to have a salt composition with the minimum amount of fluroides which are fully transferred into the produced granulated metal-salt mixture, thus improving its corrosion resistance. Moreover, utilization of fluorides in certain processes of treating liquid metal, for example cast iron and ferroalloys, is desirable as it may be instrumental in upgrading the metal by removing harmful impurities.

The actual composition of the salt additions meeting the above described requirements may be widely varied. However, there are a number of optimum compositions whose formulation requires the following considerations to be taken in mind:

the melting temperature of the salt addition should be higher than that of magnesium;

the density of the salt addition should be equal to 0.95–1.2 of the density of the liquid metal in the temperature range of 670°–730°C:

the molten salt melt should efficiently wet the liquid metal without being reduced by the latter;

the salt melt after solidification should have minimum hygroscopicity;

the salt mixture, other things being equal, should least affect the corrosion resistance of the granulated magnesium; and the salt mixture should be inexpensive and contain the minimum amount of high-melting admixtures such as magnesium oxide.

These requirements are met by the following compositions of the salt addition.

According to the invention, the liquid magnesium may use a salt addition comprising in percent by weight:

40–65 KCl,
25–50 NaCl,
3–10 $MgCl_2$,
up to 5 $CaCl_2$,
up to 0.8 F,
not over 0.5 MgO.

The liquid magnesium alloy according to the invention may use the salt addition comprising in percent by weight:

30–50 KCl,
10–40 $MgCl_2$,
up to 5.0 $CaCl_2$,
up to 0.8 F,
not over 0.8 MgO,
3–15 $BaCl_2$,
the balance — NaCl.

Magnesium oxide is an undesirable admixture impairing the granulating process, therefore conditions should of necessity be provided during the preparation of the salt additions to prevent the formation of magnesium oxide in the melt.

For the purpose of producing a magnesium-containing granulated material possessing minimum hygroscopicity and high corrosion resistance, the liquid metal according to the invention may receive a salt addition composed of the less hygroscopic sodium and potassium chlorides taken in proportion of 1.1 to 1.5 and sodium fluoride taken in the amount of 0.5–10 percent by weight, and the total content of the more hygroscopic barium, magnesium and calcium chlorides should not be over 5 percent by weight.

The selected combination of sodium and potassium chlorides approximately corresponds to an equimolecular mixture with the minimum melting temperature (~650°C); addition of fluorides brings a further lowering of the melting temperature and a certain increase of the density of the salt addition and, what is of principal importance, improves the corrosion resistance of the material produced.

For granulating pure magnesium, the content of alkaline-earth metal (Ba, Ca, Mg) chlorides should be reduced to the minimum, with the permissible occurrence of magnesium chloride in the amount of 2–3 percent by weight. In granulating a magnesium alloy, preference should be given to barium chloride for the purpose of increasing the density of the salt addition.

The application of the above described compositions of salt additions, taking account of the necessary relation of melting points of the salt additions and the liquid metal, provides conditions suitable for the realization of the controlled granulating process.

To produce granulated metal comprising not less than 50 percent of granules of spherical and ellipsoidal shapes according to the invention, the liquid metal should receive the salt addition in the amount of 2.5 to 20 percent by weight. With this, the larger the use of the salt addition within the indicated limits, the more granules will have a spherical or an ellipsoidal shape. With salt addition used in the amount of 20 percent by weight the product will practically include 100 percent of spherical and ellipsoidal particles.

To produce granulated metal comprising not less than 50 percent of elongated granules whose length is at least twice their diameter, the liquid metal should receive 0.5–2.5 percent by weight of the salt addition. With the reduction of the amount of the salt addition below 2.5 percent by weight the content of elongated particles in granulated magnesium increases.

Granules of magnesium-containing mixtures produced during the process of atomization in air, after being cooled down and sieved, represent a commercial product used in desulphurization, deoxidation and inoculation of cast iron, steel, ferroalloys.

In addition to that, the disclosed method opens the way for the production of granulated magnesium and its alloys which in terms of purity and the content of active magnesium are not inferior to magnesium powders produced by more expensive methods (milling or atomization in the atmosphere of hydrocarbon gas or inert gas).

To produce such a material according to the invention, granulated metal after being air cooled to 600°–100°C is subjected to the hydrochemical treatment within 0.5–5 min. The combination of the disclosed method and the hydrochemical treatment makes the latter treatment cheaper due to the utilization of the heat of the granules. Besides, the hydrochemical treatment process itself becomes substantially simpler in comparison with known processes for treating products made of magnesium alloys.

For the hydrochemical treatment according to the invention, use can be made for example of a 1–10 percent solution of alkali metal bichromate at a temperature of 10°–35°C and with a weight ratio of the mixture of granules to the solution from 1:2 to 1:20. After being subjected to the hydrochemical treatment and drying by known and appropriate methods, the granulated magnesium may comprise 98–99.6 percent by weight of active magnesium.

The method of the present invention is believed to be universal because it permits the production of a wide range of magnesium-containing granulated materials able to meet the requirements of diverse consumers — metallurgical, foundry and chemical industries. Thus, mixtures obtained during the production of granules of magnesium and its alloys are successfully used in desulphurization and inoculation of cast iron with a higher efficiency than with the use of magnesium powders produced by the milling method.

The mixtures produced according to the invention are looser in nature, have a bulk weight of 0.9 to 1.2 g/cm$^3$, carry no explosion hazard, while the temperature of their self-ignition is 400°–500°C higher than that of magnesium powders produced by the milling method.

The mixture obtained during the production of granules of magnesium and its alloys according to the invention may comprise in percent by weight:

65–97 granulated magnesium,
0.3–16 magnesium and alkali metal-chlorides,
0.1–10 one of the fluorides,
up to 3.0 alkaline-earth metal-chlorides,
not over 6.0 magnesium oxide.

The mixture obtained during the production of granules of magnesium and its alloys according to the invention may also comprise in percent by weight:
60–97 granulated magnesium alloy,
0.3–16 magnesium and alkali metal chlorides,
0.1–10 one of the fluorides,
0.3–10 akaline-earth metal fluorides,
not over 5.0 magnesium oxide.

The most corrosion-resistant mixtures according to the invention are those in which the salt addition composed of chlorides and fluorides comprises in percent by weight: not over 5.0 of magnesium, calcium and barium chlorides, taken separately or in combination, up to 2.0 of sodium and magnesium fluorides, the balance — sodium and potassium chlorides taken in a proportion of 1.1 to 1.5.

The corrosion resistance of the mixture is improved by a reduction in the general hygroscopicity of the component salts included therein, as well as by the passivation of the granules by means of fluorine ions introduced into the salt addition in the form of sodium or magnesium fluoride.

Depending on the process conditions described above, granulated magnesium can be obtained containing more than 50 percent of the spherical or ellipsoidal granules. This material is of good fluidity and its utilization is preferable in processes where air conveyance facilities are used. It is also possible to obtain granulated magnesium containing more than 50 percent of the elongated granules whose length is at least two times their thickness. This material is of less fluidity but features better mouldability and larger overall surface area. Such material is preferable for use in the production of various compositions with other materials. For example, it may be used in producing ferro-magnesium or ferro-silicon-magnesium briquettes for inoculating cast iron.

By subjecting granulated magnesium to a hydrochemical treatment, say, in alkali metal bichromate, granulated magnesium can be purified from chloride and magnesium oxide admixtures, yielding a product consisting chiefly of spherical or ellipsoidal granules or elongated granules with the minimum content of chlorides (chlorine ions) and oxide.

Thus, a material is produced wherein the content of chlorine ions is not over 0.4 percent by weight and that of magnesium oxide is up to 1.0 percent by weight.

A number of actual examples of the above method and the materials produced by using same will now be described.

EXAMPLE 1

A chamber-enclosed centrifugal granulator is employed to pulverize liquid electrolytic magnesium having a temperature of 720°C with a rotational speed of the preforated cup of 1000 rpm. In the course of being poured into the granulator, the magnesium receives 0.5 percent by weight of the salt addition heated to a temperature of 730°C. The salt addition is of the following composition in percent by weight: 10.0 $MgCl_2$, 48.0 KCl, 39.08 NaCl, 2.0 $CaCl_2$, 0.02 MgO.

Liquid particles of the magnesium-salt mixture flung through the holes in the rotating cup by the action of the centrifugal force are cooled in their flying trajectory by the counter air flow drawn through the chamber by means of a fan.

After becoming solidified, the granules produced thereby consisted in 80 percent of elongated fused particles in the form of commas or strings whose diameter in the thickest portion was 0.4 to 2 mm and the length 1 to 15 mm.

The above product has been analyzed for the content of chlorion (Cl) (an indicator of the residual content of chlroides in granules of magnesium) and magnesium oxide. The results of the analysis revealed that this product included percent by weight: 0.21 chlorion (Cl), 2.8 MgO and 0.1F$^1$.

EXAMPLE 2

The process conditions are similar to those described in Example 1, but the amount of the salt addition is increased to 2.1 percent by weight.

Granulated magnesium produced thereby consisted in 60 percent of elongated granules shaped as described in Example 1, while the remaining 40 percent were spherical or ellipsoidal granules 0.4 to 2.5 mm in diameter coated with a thin salt film.

Granulated magnesium produced thereby had a content of 1.1 percent by weight 1.1 chlorion and 3.2 MgO.

EXAMPLE 3

The process conditions are similar to those described in Example 1, but the amount of the salt addition is increased to 2.6 percent by weight.

Granulated magnesium produced thereby consisted in 55 percent of spherical or ellipsoidal granules, while the remaining 45 percent were elongated granules shaped as described in Example 1.

Granulated magnesium produced thereby had a content in percent by weight of: 1.5 chlorion and 2.5 MgO.

EXAMPLE 4

The process conditions are similar to those described in Example 1, but the amount of the salt addition is increased to 20 percent by weight.

Granulated magnesium produced thereby included 1.5 percent of elongated granules, while the remaining granules were of regular spherical or ellipsoidal shape. The granules are coated with a thin salt film.

Apart from metal granules the product contained about 6 percent of spherical salt addition particles.

The results of the chemical composition analysis of the product obtained in percent by weight: 9.5 chlorion, traces of MgO.

EXAMPLE 5

The process conditions are similar to those described in Example 4, but the salt addition contains 0.2 percent by weight $F^1$.

Granulated magnesium produced thereby included 95 percent of ball-shaped granules, 0.4 to 2.5 mm in diameter.

The results of the chemical composition analysis in percent by weight: 8.3 chlorion, 0.03 $F^1$, MgO — not found.

EXAMPLE 6

A chamber-enclosed granulator is employed to pulverize a liquid magnesium alloy containing 8 percent by weight Al and 1.0 percent by weight Zn with a rotational speed of the perforated cup of 1200 rpm. The cup diameter is 100 mm, the diameter of the working holes 1.2 mm.

Before being poured into the granulator, the liquid magnesium alloy was heated to a temperature of 680°C.

The alloy was given 0.5 percent by weight of the salt addition of the following composition in percent by weight: 40 $MgCl_2$, 43 KCl, 6 NaCl, 10 $BaCl_2$, 0.6 $CaCl_2$, 0.2 $F^1$ and 0.4 MgO.

The temperature of the salt addition before introduction to the alloy was 700°C.

Liquid particles of magnesium alloy and salt addition flung from the working holes of the rotating cup were cooled by counter flows of air drawn through the chamber by means of a fan.

Granules produced thereby after becoming solidified consisted of 80 percent of elongated fused particles in the form of commas or strings.

The results of the analysis revealed that this product included percent by weight: 0.24 chlorion, 3.0 MgO and 1.0 $F^1$.

EXAMPLE 7

The process of granulating magnesium alloy including percent by weight: 8.0 Al and 1.0 Zn is carried out similarly to that described in Example 6, but with the amount of the salt addition of the same composition equal to 12 percent by weight of the alloy being pulverized.

The product consisted of 95 percent of spherical and ellipsoidal granules which, when sieved on standard sieves, passed through 2.5 mm holes. The results of the chemical analysis revealed that this product included percent by weight: 5.2 chlorion and 0.1 $F^1$.

EXAMPLE 8

Raw magnesium is heated to 700°C and given 10 percent by weight of the salt addition heated to 720°C of the following chemical composition percent by weight: 2 $MgCl_2$, 53.5 KCl, 44 NaCl, 0.5 NaF. The mixture of magnesium and salt addition is atomized by means of the rotating perforated cup, 100 mm in diameter, with the diameter of the working holes equal to 1.5 mm. The cup rotates at a speed of 1000 rpm.

After being cooled down in air, the product was subjected to sieve and chemical analyses.

The product contained 85 percent of spherical granules sized 0.5–2.5 mm. The results of the chemical analysis in percent by weight: 4.0 $Cl^-$,0.1 MgO, 0.15 of $F^1$.

EXAMPLE 9

Granules produced by the method described in Example 8 are air cooled to a temperature of 100°C and then submerged for 0.5 min in a vessel containing a 1 percent solution of $K_2Cr_2O_7$ with an initial temperature of 35°C.

The ratio between the amount of granules and that of the solution is 1:2. After a 0.5 min period the granules are removed from the solution and dried at a temperature of 120°C for 1 hour.

The above product was analyzed for the content of chlorion and magnesium oxide. The results of the analysis: 0.36 percent by weight $Cl^-$, 0.6 percent by weight MgO.

EXAMPLE 10

Granules produced by the method described in Example 8 are cooled to 600°C and submerged in a vessel containing a 5 percent solution of $K_2Cr_2O_7$ having a temperature of 10°C, the ratio of the amount of granules to the mass of the solution being 1:20.

After a 2 min period the granules are removed from the solution, washed in water and dried for 1 hour at a temperature of 120°C in a drying cabinet.

The results of the chemical analysis of the above granulated magnesium in percent by weight are as follows: 0.02 $Cl^-$, 0.1 MgO.

EXAMPLE 11

Several versions of granulated magnesium and its alloys produced by the methods described in Examples 1–8 were subjected to a comparative test of properties.

Actual compositions of the samples are given in Table 1.

Table 1

| Composition | Sample 1 | Sample 2 | Sample 3 | Sample 4 | Sample 5 |
|---|---|---|---|---|---|
| | Content in weight percent | | | | |
| Granulated magnesium | 96.0 | 80.0 | — | 89.1 | 92.5 |
| Granulated magnesium alloy | — | — | 96.0 | — | — |
| Chlorine ions | 0.21 | 9.5 | 0.24 | 5.2 | 4.0 |
| Flourine ions | 0.1 | — | 0.1 | 0.1 | 0.15 |
| Magnesium oxide | 2.8 | — | 3.0 | — | 0.1 |
| Shape of particles | elongated | spherical, ellipsoidal | elongated | spherical, ellipsoidal | spherical 85 percent elongated 15 per |

Table 1-continued

| | | | | | cent |
|---|---|---|---|---|---|
| Ignition temperature, °C | 650 | 1000 | 620 | 920 | 900 |
| Bulk weight, g/cm³ | 0.83 | 1.0 | 0.91 | 1.2 | 0.98 |

The samples were tested for corrosion resistance in a humid atmosphere for which purpose they were kept above water in an desiccator for 12 hours.

After the 12-hour period of keeping the samples above water they were dried and their moisture content was determined by the change of their weight before and after the treatment in the desiccator.

Samples No. 2 and 4 revealed a weight increase of 12–15 percent, samples No. 1 and 3 — 3 percent, sample No. 5 — 3.5 percent.

Samples Nos. 2, 4, 5 were tested in the desulphurization of cast iron. The process of desulphurization was carried out in a 60-t capacity ladle by injecting magnesium or magnesium alloy granules into the cast iron by compressed air with the help of a tuyere.

The amount of the product used in all tests was equal to 0.35 kg per 1 t of cast iron. The initial sulphur content in cast iron — 0.045 percent by weight.

The results of desulphurization are given in Table 2.

Table 2

| Results of desulphurization | Sample No. 2 | Sample No. 4 | Sample No. 5 |
|---|---|---|---|
| Final sulphur content in cast iron in per cent by weight | 0.03 | 0.03 | 0.026 |
| Character of desulphurization process | vigorous "boiling" of cast iron with liberation of a large amount of smoke | vigorous "boiling" of cast iron with liberation of a large amount of smoke | process intensity twice calmer than with Samples No. 2 and 4 |

The inventive method of producing granules of magnesium and its alloys opens a way to obtain granules of a given shape and desired chemical composition.

Moreover, the invention permits selecting a salt addition of a chemical composition which assures the normal operation of the granulating process in air to produce magnesium-containing mixtures consisting of the desired amounts of metal granules and added salt. The salt is found in the mixture both in the form of the granules and in the form of a thin film covering the surface of the metal granules, thus making the mixture explosion-proof and less flammable.

The present invention allows such mixtures to be produced which are instrumental in increasing the rate of utilization of magnesium when used for treating cast iron and other metals for the purpose of desulphurization or inoculation.

The granulating process performed with the above salt additions assures the normal operation of the granulating process and easy removable of the salt by subsequent hydrochemical treatment. This makes it possible to produce granulated magnesium or its alloys which in activity are practically equivalent to magnesium powders produced by milling or atomizing in an inert atmosphere.

What we claim is:

1. A magnesium-salt powder consisting essentially in weight percent of 65 to 97 granulated magnesium, 0.3 to 16 magnesium and alkali metal chlorides, 0.1 to 10 of a fluoride selected from the group consisting of alkali and alkaline-earth metal fluorides, up to 3 alkaline-earth metal chlorides, and up to 6 magnesium oxide.

2. A magnesium-salt powder consisting essentially in weight percent of 60 to 97 granulated magnesium alloy, 0.3 to 16 magnesium and alkali metal chlorides, 0.1 to 10 of a fluoride selected from the group consisting of alkali and alkaline-earth metal fluorides, 0.3 to 10 alkaline-earth metal chlorides, and up to 5 magnesium oxide.

3. The mixture as defined in claim 2, wherein the salt addition amounts to 2.5 to 20 weight percent, and wherein over 50 percent of the granulated magnesium has spherical or ellipsoidal granules.

4. The mixture as defined in claim 2, wherein the salt addition amounts to 0.5 to 2.5 weight percent, and wherein over 50 percent of the granulated magnesium has elongated granules whose lengths are at least twice their thicknesses.

5. The mixture as defined in claim 2, wherein the salt addition comprises up to 5 weight percent of at least one component selected from the group consisting of magnesium, calcium and barium chlorides, up to 2 weight percent of at least one component selected from the group consisting of sodium and magnesium fluorides, the balance being sodium and potassium chlorides taken in a proportion from 1.1 to 1.5.

6. The mixture as defined in claim 5, wherein the salt addition amounts to 2.5 to 20 weight percent, and wherein over 50 percent of the granulated magnesium has spherical or ellipsoidal granules.

7. The mixture as defined in claim 5, wherein the salt addition amounts to 0.5 to 2.5weight percent, and wherein over 50 percent of the granulated magnesium has elongated granules whose lengths are at least twice their thicknesses.

* * * * *